US005483223A

United States Patent [19]

Pedtke

[11] Patent Number: 5,483,223

[45] **Date of Patent: *Jan. 9, 1996**

[54] PERSONAL SECURITY SYSTEM WITH END-TO-END TEST

[75] Inventor: Daniel F. Pedtke, Palmyra, N.Y.

[73] Assignee: Detection Systems, Inc., Fairport, N.Y.

[ * ] Notice: The term of this patent shall not extend beyond the expiration date of Pat. No. 5,467,074.

[21] Appl. No.: 387,953

[22] Filed: Feb. 13, 1995

Related U.S. Application Data

[63] Continuation of Ser. No. 126,841, Sep. 20, 1993, Pat. No. 5,467,074, which is a continuation-in-part of Ser. No. 835, 847, Dec. 18, 1992, abandoned.

[51] Int. Cl.[6] ..... G08B 1/08

[52] U.S. Cl. ..... 340/539; 340/531; 340/514

[58] Field of Search ..... 340/539, 531, 340/514, 825.06, 825.69, 825.72; 455/67.1, 68, 70, 38.1, 38.2, 92, 95, 100, 54.6; 341/173, 174, 176

[56] References Cited

U.S. PATENT DOCUMENTS

| | | | |
|---|---|---|---|
| 3,833,895 | 9/1974 | Fecteau | 340/224 |
| 4,334,221 | 6/1982 | Rosenhagen et al. | 340/825.72 |
| 4,396,910 | 8/1983 | Enemark et al. | 340/539 |
| 4,884,060 | 11/1989 | Shapiro | 340/514 |
| 4,908,602 | 3/1990 | Reich et al. | 340/514 |
| 4,998,095 | 3/1991 | Shields | 340/574 |
| 5,365,217 | 11/1994 | Toner | 340/539 |

*Primary Examiner*—Donnie L. Crosland
*Attorney, Agent, or Firm*—J. Addison Mathews

[57] ABSTRACT

A personal security system includes a test feature for end-to-end testing. A portable transmitter produces an emergency signal including a personal identification number and an auxiliary code. The auxiliary code may be a test bit which, when set, indicates that the emergency signal was activated in a test mode and that an emergency condition did not exist. Activation of the test mode is accomplished by the same systems required to activate the emergency signal to provide full testing. The transmitter is part of a security system including a plurality of portable transmitters and fixed receivers. The transceivers issue either an alarm activating signal or a test signal depending on the test bit in the auxiliary code. A successful test is discernible to the user from the vicinity of the transceiver.

5 Claims, 6 Drawing Sheets

PERSONAL SECURITY SYSTEM WITH END-TO-END TEST

CROSS-REFERENCE TO RELATED APPLICATIONS

This application is a continuation of my U.S. patent application Ser. No. 08/126,841, filed Sep. 20, 1993 now U.S. Pat. No. 5,467,074; which is a continuation-in-part of my U.S. patent application Ser. No. 07/835,847, filed on Dec. 18, 1992 and now abandoned; both entitled Personal Security System With Transmitter Test Mode.

Reference also is made to commonly-assigned, U.S. patent application Ser. No. 07/726,360, entitled PERSONAL SECURITY SYSTEM TRANSMITTER WITH AUXILIARY CODE, filed Jul. 5, 1991 in the names of D. Pedtke et al., now abandoned; Ser. No. 07/726,362, entitled PERSONAL SECURITY SYSTEM NETWORK, filed Jul. 5, 1991, in the names of K. Kostusiak et al., now U.S. Pat. No. 5,115,224, issued May 19, 1992; and Ser. No. 07/726,363, entitled PERSONAL SECURITY SYSTEM NETWORK WITH FALSE ALARM PREVENTION, filed Jul. 5, 1991, in the names of T. Heckleman and D. Pedtke, now U.S. Pat. No. 5,111,187, issued May 5, 1992.

BACKGROUND OF THE INVENTION

1. Field of the Invention

The present invention relates to a network of transceivers which monitor a defined geographic area for the receipt of transmissions indicative of emergency situations, and which relay an alarm signal to a central station for appropriate action. More specifically, the invention is directed to an improved transmitter and transceiver network wherein a test mode is actuatable to determine operability of the electrical and mechanical components of the system.

2. Description of the Prior Art

Emergency transmitter systems are known in the art. U.S. Pat. No. 4,998,095, issued in the name of Neal G. Shields on Mar. 5, 1991, describes such a system for individuals within a predetermined geographic area like a campus, shopping mall, or stadium. A plurality of fixed transceivers at selected locations in the area monitor radio frequency emergency transmissions from portable transmitters. Transmissions include a code identifying the individual assigned the portable transmitter. The transceiver forwards this code, along with its own unique code, to a central station where the identity of the individual and his or her location is displayed. The location is determined from the unique code of the fixed transceiver that forwarded the information.

The success of the system depends, of course, on the operability of the transmitter, which may be adversely affected by a low battery, physical abuse, or the effects of the environment (such as, for example, exposure to humidity or dirt). Therefore, it is important that a user be able to test the transmitter from time to time. It is equally important that the test be one which will insure that the user is within the monitored region of a transceiver and that the emergency signal is actually being received by a transceiver. Other than by actually initiating an alarm, there is no provision in Shields for testing the system to determine operability.

Some known security systems do provide a test mode. U.S. Pat. No. 4,908,602, issued Mar. 13, 1990, to Richard M. Reich et al., relates to an emergency response system capable of testing the condition of a battery in a portable unit by physically setting the receiver for a test. The receiver then assumes that any transmission from the portable unit is for test purposes only, and no alarm signal is sent to the central monitoring station. While such an arrangement may be satisfactory for the Reich et al. system, where the user has physical access to the receiver, it is not particularly attractive for users of portable transmitters associated with inaccessible transceivers. The Shields transceivers, for example, preferrably are located where access is difficult. Similarly, the system is intended for multiple users, and there should be little or no risk that the system accidently will be left in the test mode or made unavailable even for short periods of time.

It is proposed, accordingly, that the portable transmitter include provisions for designating when a transmission is intended to be a test and when it is intended to designate the existence of an actual emergency condition. One might provide distinct buttons for each mode, as disclosed in the above-referenced application Ser. No. 07/726,360. It is preferrable, however, in accordance with the most specific features, to test the very same electrical contacts of the "alarm" button; since it may be the button's mechanical contacts that cause the electronic components fail.

SUMMARY OF THE INVENTION

The present invention is directed to overcoming one or more of the problems set forth above. Briefly summarized, according to one aspect of the invention, a security system is provided that includes portable transmitters and fixed receivers. The transmitters operate in first and second modes, respectively, for transmitting emergency or test signals. The transceivers operate in corresponding modes and issue either an alarm activating signal or a test signal. A successful test is discernible to the user from the vicinity of the transceiver.

According to one feature of the invention, a portable transmitter for use with a personal security system operates in a first mode for transmitting an emergency signal and in a second mode for transmitting a test signal. In the first mode, actuation of an alarm switch element or elements causes the transmitter to produce an identification code unique to the existence of an emergency condition, and in the second mode, actuation of the same alarm switch element(s) causes the transmitter to produce an identification code unique to a test condition. Thus, activation of the test signal requires activation of the same switch element or elements that are used to create an emergency signal. When a user successfully completes a test operation, He or she can be assured that all components required to create an emergency signal are also operable.

According to more specific features of the invention, a portable transmitter produces an emergency signal including a personal identification number and an auxiliary code. The auxiliary code may be a test bit which, when set, indicates that the emergency signal was activated in a test mode and that an emergency condition did not exist. Activation of the test mode is accomplished by the same systems required to activate the emergency signal to provide full testing.

According to still more specific features, a central station includes subscriber information, and communicates with the transceiver during a test. A successful test is indicated only when the communication with the central station is properly completed, thus testing the security system from end-to-end. In accordance with a particularly advantageous feature, each transmission includes a unique code identifying the originating transmitter, and the test compares the unique code to the subscriber information in the central station. A successful system test by a current subscriber will provide a first predetermined local signal. A successful system test by a delinquent subscriber will provide a second predetermined signal.

ADVANTAGEOUS EFFECTS OF THE INVENTION

A number of important features and resulting advantages in personal security systems are provided by the invention that were not previously available. The test mode is selectable at the transmitter, by the user, and operates to test the entire system from end-to-end. It tests the very same mechanical and electrical switch elements required for proper operation of an alarm. It tests receipt of the transmitted signal and the information contained in that signal, including, for example, the identification of the user. It tests proper re-transmission by the transceiver and receipt of the signal and information by the central station. At the central station, the information can be compared to subscription information to see if the testing user is recorded as an active or current subscriber.

Testing does not require access to the transceivers, which may be located out of reach on light poles. A test also runs to completion automatically, after which the transmitter is returned to its prior condition without any additional action required by the user. He or she connot accidentally leave the transmitter in a test or non-alarm mode.

Multiple tests by several different users are possible, while simultaneously maintaining the system fully capable of receiving an alarm from still other users. Although a particular transmitter may issue a test signal, the transceiver and central station remain capable of receiving alarms.

Unlike prior systems, significant preparation or planning is not required for a full system test. Reasonably frequent or spur-or-the-moment testing, so important to user confidence, may be accomplished at any time without prior planning or access to a specific location for setting the test mode. Users can test the proper operation of the entire system including their particular transmitter often, from any location, at their own convenience.

In addition to user benefits, intermittent testing by a number of different users, from different locations, reduces the need for scheduled tests of the system by its owner or operator. Similarly, the system operator may benefit from knowing those subscribers who have not tested the system. Non-testers might be contacted to make sure they know how to use their transmitter.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
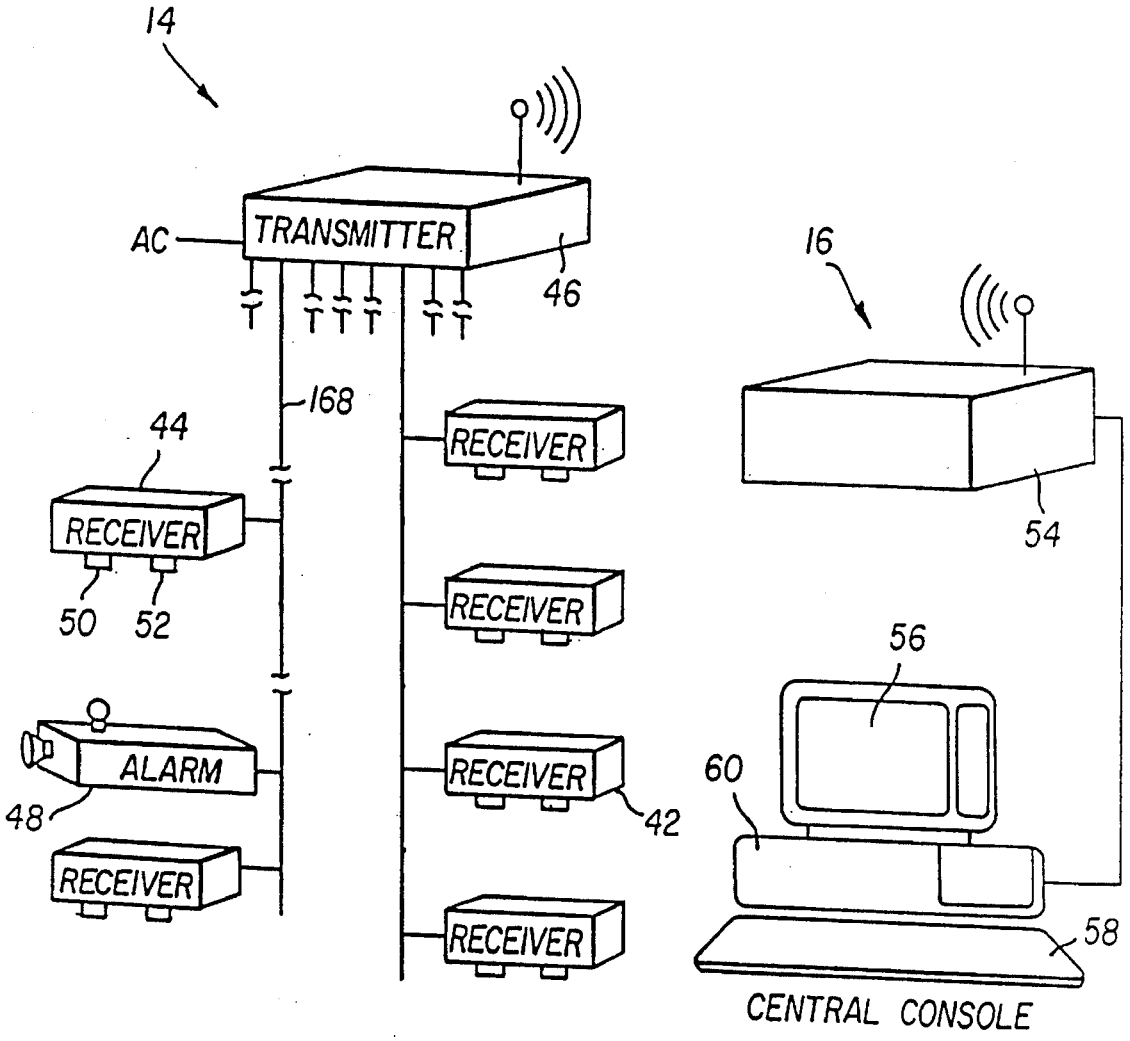
FIG. 1 is a schematic representation depicting a portable transmitter and security system according to the invention.
Figure 1:
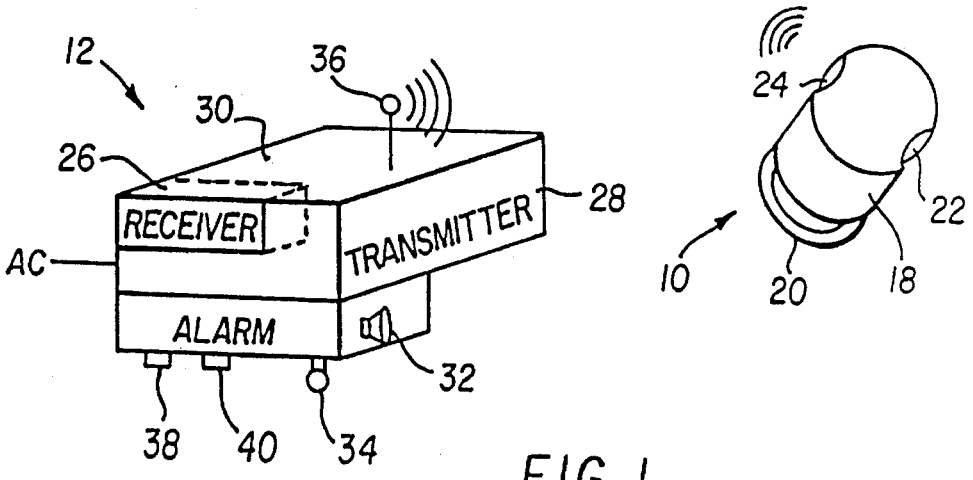

Referring now to FIG. 1, and a preferred embodiment of the invention, a personal security system is depicted including portable transmitters 10, combinations of fixed receivers and fixed transmitters sometimes called transceivers 12 and 14, and a central station 16.

The portable transmitter 10 is battery powered and adapted for convenient carrying in a purse or pocket. It is enclosed in a plastic case 18 including a key ring 20 and two external switches depicted as buttons 22 and 24. The switches are designed for actuation from opposite sides of the case against a spring bias and in a sequence that normally prevents accidental operation.

As will be described more fully hereinafter, the switches initiate operation of the transmitter, either in an alarm state or a test state, depending of the sequence of actuation. In both cases, alarm or test, the transmitter produces and transmits a radio frequency signal to the local geographic area at a predetermined frequency and signal strength. The frequency may be in the three hundred or nine hundred megahertz range typical for such applications. The signal strength may vary somewhat, depending on battery life and other factors, but is chosen in combination with the number and locations of the fixed receivers so more than one and preferably three receivers typically will be able to interpret the transmitted signal for the purposes to be described. At the same time, the signal strength, which falls off inversely with distance, should be weak enough to facilitate location of the portable transmitter based on differences in the signal strength at the respective receivers that are able to interpret the signal.

The fixed receivers in this preferred embodiment are illustrated with fixed transmitters in two different combinations. The combination depicted at 12 is preferred for outdoor use and includes a receiver 26 and transmitter 28, actually a transponder, collocated and coupled with appropriate logic in a single weatherproof box or container 30. The container includes a battery for back-up, but is adapted for mounting on a pole, including an electrical source, in association with an audible alarm or siren 32 and visible alarm or strobe 34. The receiver is positioned for good radio reception from the surrounding area, and is provided with appropriate antennas for monitoring the portable transmitters 10 and for communicating with the central station 16. Only one such antenna 36 is shown. Other visible indicators are provided in the form of a green emitting LED (light emitting diode) 38 and a red emitting LED 40, for purposes to be described hereinafter in connection with the alarm and test modes of the invention.

The other combination of receivers and transmitters is depicted at 14, and includes a plurality of receivers 42 and 44 that are multiplexed with appropriate additional logic for operation with a common transmitter 46, again a transponder. One or more alarms 48, including sirens and strobes, are multiplexed with the receivers to appropriate logic in the transponder. The receivers 42 and 44 are tunned to receive transmissions from the portable transmitters 10 and communicate related information to the transponder 46. Red and Green LEDs, 50 and 52, are arranged on the receivers for convenient viewing from the surrounding geographic area. The LEDs preferably are positioned at locations where a subscriber might want to see the results of a system test before or upon entering an area of questionable security. In a college dormitory, the LEDs might be on the receivers in the hallways.

The transponder 46 interrogates the receivers and alarms, and transmits related information to the central station. It also receives commands from the central station which it either carries out itself or directs the receivers or alarm to complete. In the preferred embodiment, one frequency is used for communications between the portable transmitter 10 and the receivers 26, 42, and 44, and a different frequency is used for communications between the transponder 46 and central station 46.

Central station 16 includes a combined receiver and transmitter 54, a console 56, a keyboard 58 and a computer 60. The central station communicates with the fixed transmitters or transponders 28 and 46 for controlling the sirens and strobes in the alarm mode and the red and green LEDs in the test mode. The central station also is used for entering system information and parameters. It might include a map of the protected area and a program for showing the locations of receivers in the vicinity of an alarm or test transmission. Typically, the central station will store subscriber records including active or inactive status, identification of the portable transmitter assigned to each subscriber, and the times and locations from which is was used, either in an emergency or for a test.

Figure 2:
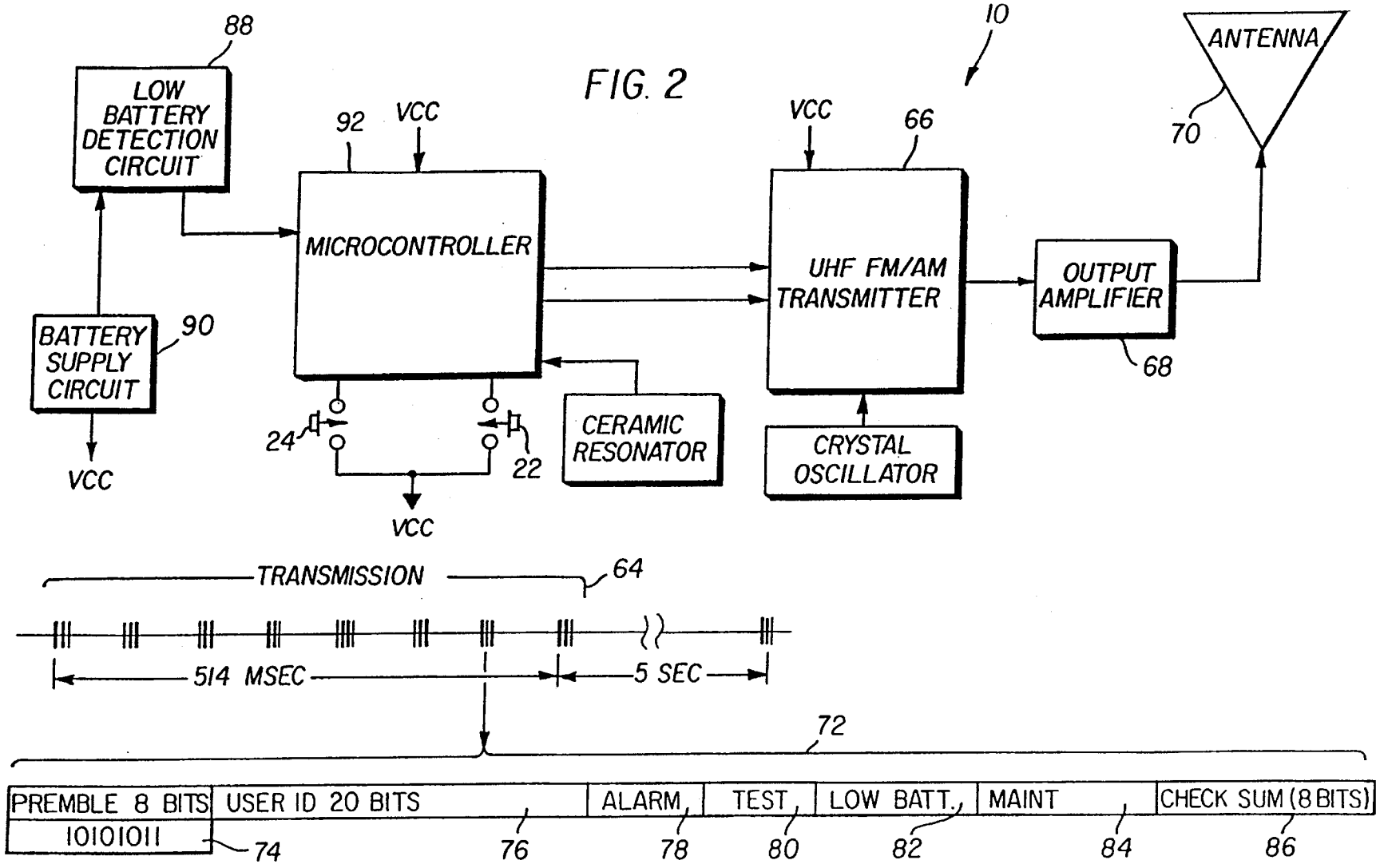
FIG. 2 is a block diagram of a portable transmitter, according to one embodiment of the invention, for issuing emergency and test transmissions.

Referring now to FIG. 2, the portable transmitter 10 and its operation are depicted in more detail. When actuated either in an alarm or a test mode the portable transmitter broadcasts to the local geographic area a series of eight identical packets of information 64 through transmitter 66, output amplifier 68 and antenna 70. The packets each contain the information identified at 72, including a preamble 74, a user or transmitter identification (ID) code 76, an alarm set bit 78, a test set bit 80, a low-battery warning set bit 82, a maintenance set bit 84 and a check sum 86 for error detection.

The ID code is programmed and stored in the portable transmitter memory either at the time of manufacture or when the user subscribes to the system. The alarm and test bits are set during actuation of switches 22 and 24, depending on the sequence of actuation. As will be described more fully in connection with FIG. 3, the alarm and test bits will indicate an alarm if actuated simultaneously and a test if actuated sequentially. The low battery bit is set by detection circuit 88 which senses the voltage in the battery supply circuit 90. The maintenance bit 84 is set by maintenance personnel.

The portable transmitter and its various functions operate under the control of a micro controller 92 which includes associated memory and appropriate timers (not shown).

It will be apparent throughout this description that the same mechanical and electrical components of the portable transmitter are used in both the test mode and the alarm mode, differing only in sequence of operation and the setting of the test and alarm bits. The same actuating switches are used, the same batteries, the same micro controller and the same transmitter and antenna.

Figure 3:
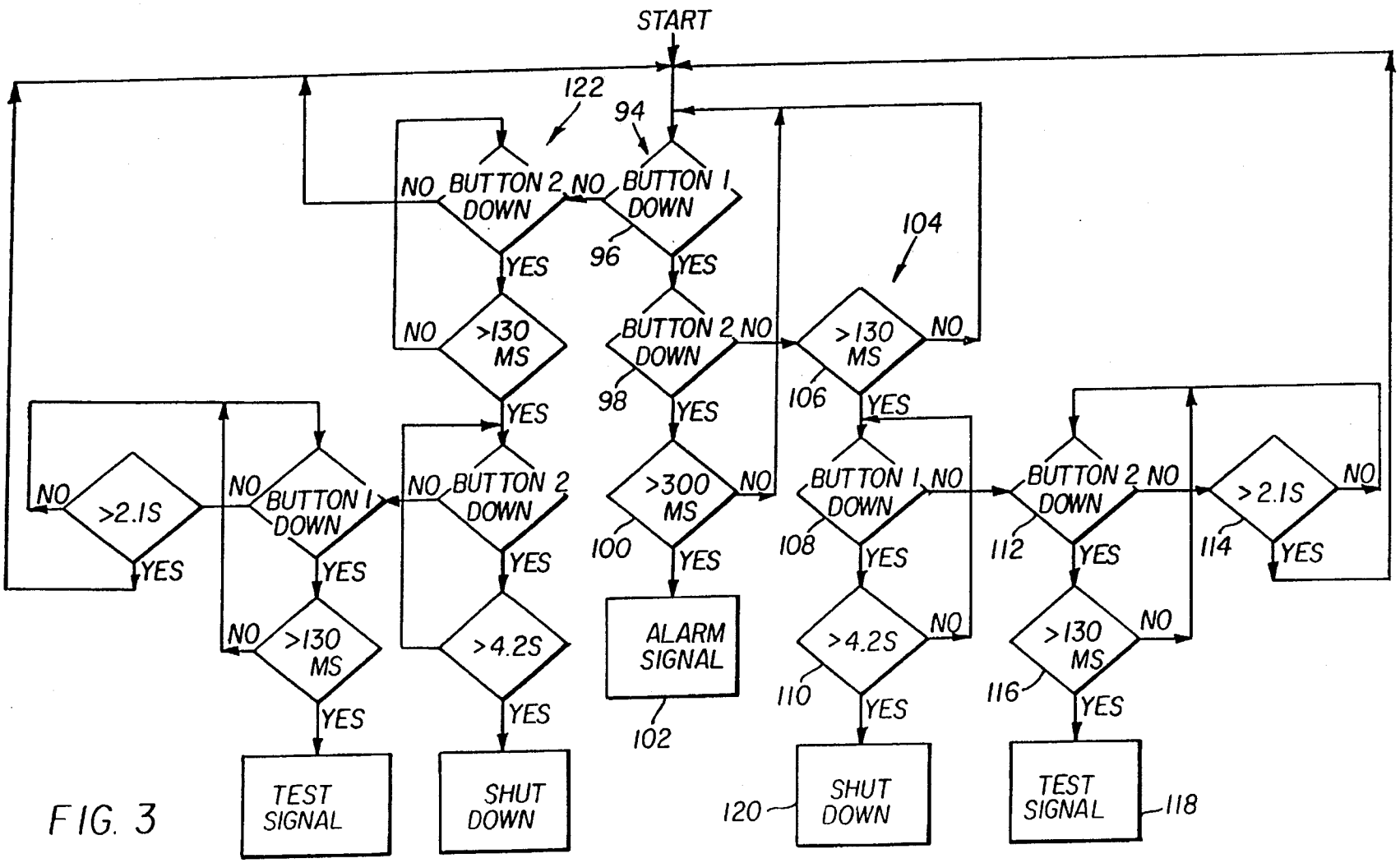
FIG. 3 is a flow diagram representing the logic associated with actuation of the portable transmitter of FIG. 2 for initiating an alarm or test transmission.

The flow diagram of FIG. 3 depicts the operation of the actuating switches 22 and 24 in more detail, particularly regarding their sequence of operation to establish the setting of the alarm and test bits 78 and 80. Basically, simultaneous actuation of the switches sets the transmitter to the alarm state, while sequential actuation sets the transmitter to the test state.

Column 94 represents simultaneous actuation and the alarm state. Button 1 (for example switch 92) and button 2 (for example switch 94) both are depressed simultaneously, 96 and 98, for at least three hundred milliseconds, 100. This sets the alarm and test bits 78 and 80 to the alarm mode, 102.

Column 104 depicts operation in a test mode. If button 1 is depressed first, 96, for at least one hundred and thirty milliseconds, 106, but not longer than four and two tenths seconds, 108 and 110, and if button 1 is then released and button 2 depressed, 112, within two and one tenth seconds, 114, for at least one hundred and thirty milliseconds, 116, then the alarm and test bits 78 and 80 are set to the test mode, 118. Holding button 1 for more than four and two tenths seconds causes the portable transmitter to shut down, 120, to conserve battery life. Such an event might be caused by pressure on the button while compressed against other objects in a purse, or the like.

Column 122 depicts operation in a test mode with button 2 depressed first. This operation is essentially the same as that already described for button 1, and will not be separately described.

Figure 4:
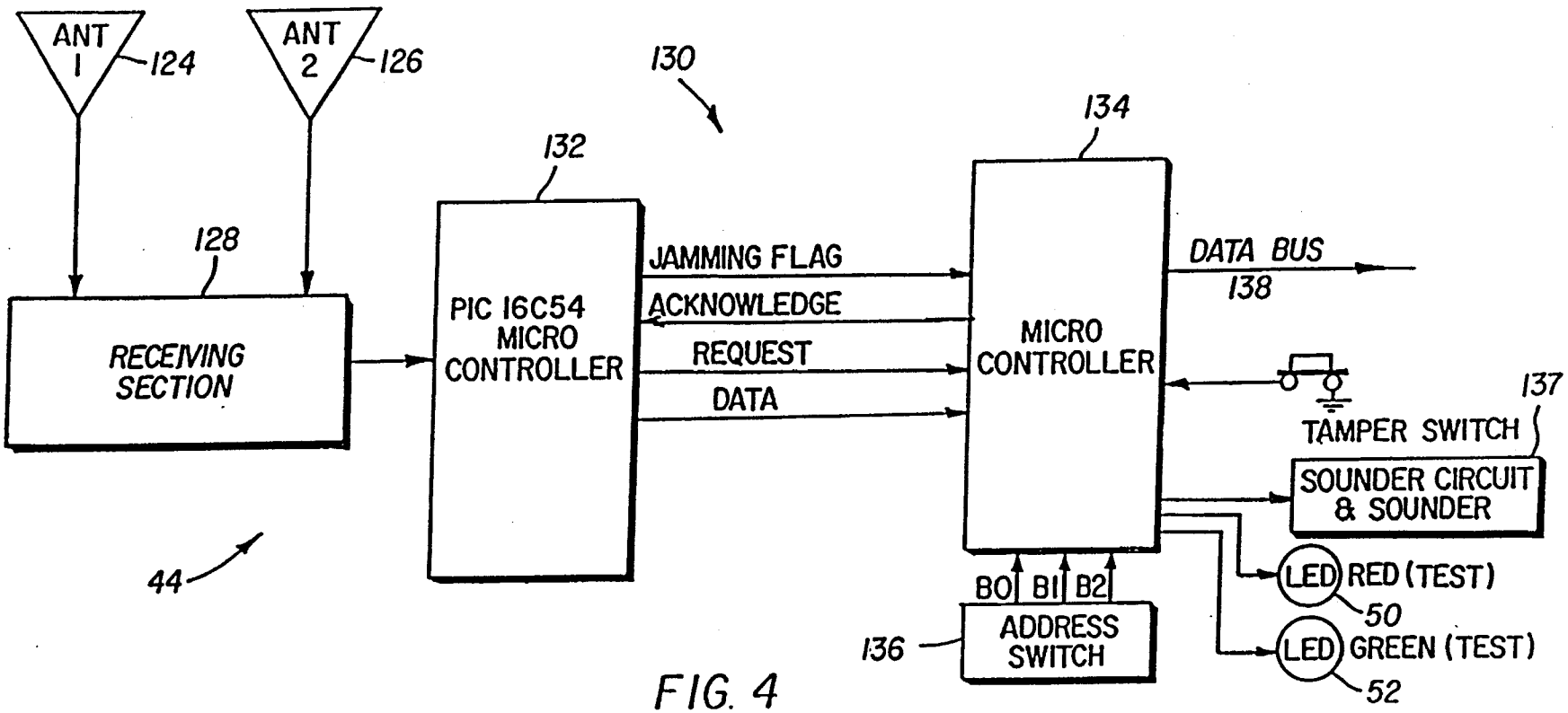
FIG. 4 is a block diagram of a multiplexed receiver according to one embodiment of the invention for receiving emergency and test transmissions from the portable transmitter.

FIG. 4 depicts a receiver 44 having diversity antennas 124 and 126, a signal receiving section 128 and a logic section 130, including a first micro controller 132 for the radio section and a second micro controller 134 for bus communications. Each receiver is identified by a unique code established at DIP switch 136 which may be set during its installation. It also includes a local sounder 136.

The receiver continuously monitors the predetermined frequency used by the portable transmitters. It decodes such transmissions, validates the transmission for proper format, samples the strength of validated signals and sets a normal/off-normal bit flag in the receiver depending on the information received. A decoded transmission, assuming it is in the proper format, is stored in a data register, including the identification number of the portable transmitter and the received signal strength along with the normal/off-normal flag bit.

The receiver communicates with its associated transponder 46, FIG. 1, through bus 138. The transponder queries each receiver using the receiver's unique identification code. If the flag bit is normal, the transponder continues with queries cycled to other receivers. If the flag bit is off-normal, indicating, for example, either an alarm or a test, the transponder requests the stored information. This includes the reason for the off-normal condition, the strength of the received signal and the unique identification code of the portable transmitter.

Several receivers preferably will store and transfer information connected with a single alarm or test. The transponder compares the information, selects the three strongest signals from a single portable and sends the information, including the identification of the receivers, on to the central station. The central station makes a similar comparison with information that might be received form other transponders and displays on its screen the location of the receivers that received the three strongest signals.

If the off-normal condition was caused by an alarm, the transponder and central station will issue commands activating the strobe and siren closest to the three above-mentioned receivers. If caused by a test, the central station will use the unique identification of the portable transmitter to look for an active subscriber and will energise the green LED 52 on the three receivers if the subscription is in order, or the red LED 50 if not. The red LED might be actuated, for example, to indicate an expired subscription. Actuation of either LED will indicate to the subscriber that the system successfully processed the signal from the portable transmitter to the central station and back, through all the same transmission and logic channels that would be required to process an alarm. The red indication differs from the green indication based on other factors, such as the status of the subscription maintained in the central control.

DETAILED DESCRIPTION OF ALTERNATIVE EMBODIMENTS

Figure 5:
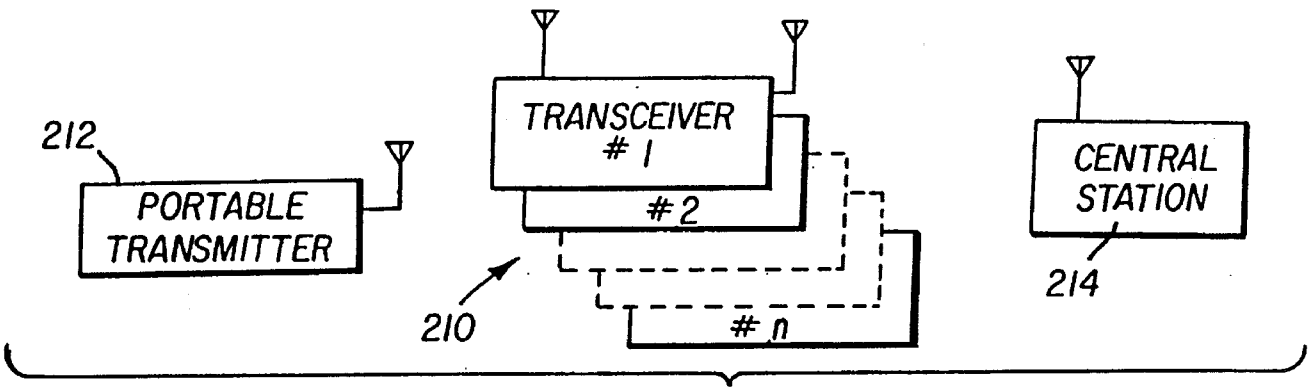
FIG. 5 is a schematic representation of an alternative embodiment of the invention depicting a geographic area provided with the personal security system network of the present invention.
Figure 6:
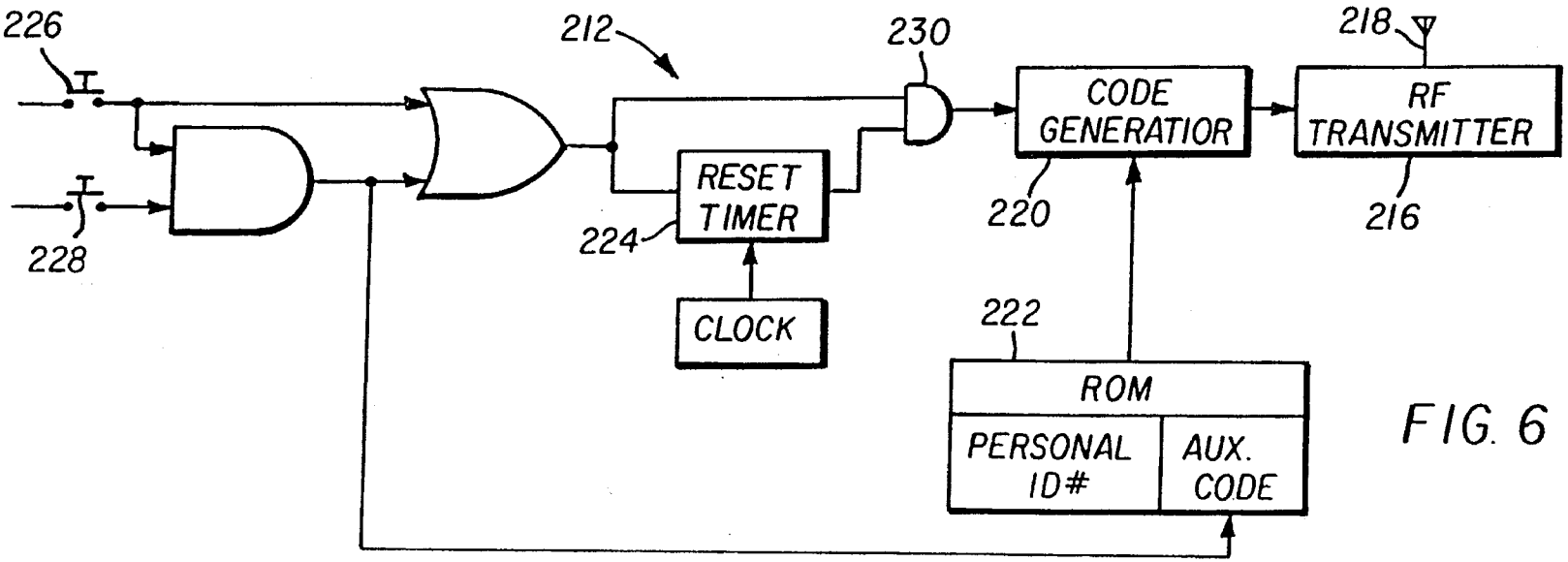
FIG. 6 is a block diagram of a portable transmitter according to the alternative embodiment of FIG. 5.

Referring now to FIGS. 5 and 6, an alternative embodiment of the invention includes a plurality of fixed transceivers 210 located in a predetermined pattern within a geographic area, such as, for example, on utility poles, sides of buildings, etc. Also shown in FIG. 1 is a portable transmitter 212 that can be carried by a person and activated to produce a radio frequency emergency signal transmission to be picked up by the fixed transceivers. The signal strength of the emergency signal received by each transceiver 10 is generally inversely related to the distance of the transceiver from the portable transmitter. A central station receiver 214 monitors alarm signals from the transceivers. Additional details of transceiver 210 and the security system network can be found in the above-referenced application Ser. No. 07/726,362, the disclosure of which is specifically incorporated herein by reference.

Referring to FIG. 6, portable transmitter 212 consists of a radio frequency (RF) transmitter 216, an antenna 218 a code generator 220 with associated memory 222, a reset timer 224, and a plurality of push buttons, of which two (226 and 228) are illustrated. It will be recognized that the push buttons can take various forms well known in the art, and the term "button" or the phrase "switch element" as used herein is intended to refer to buttons, switches, sliding contacts, and other components intended to make and break electrical circuitry.

Button 226 is an "alarm" button, and may be a single button as shown or, a pair of buttons which must be depressed simultaneously, thereby inhibiting false alarms. Button 228 is a "mode" button to be depressed along with button(s) 226 to signify that the transmission is for test purposes only.

The purpose of reset timer 224 is to inhibit re-activation of an alarm signal within a predetermined time period so as to prevent a series of false alarms as explained in the above-referenced application Ser. No. 07/726,363.

Code generator 222 has been illustrated as a read only memory (ROM). It will be understood that the function described can be derived from various types of memory if desired. The code generator stores a personal identification code such as a multiple bit word which is unique to the individual transmitter so as to provide an identity signal when the transmitter is activated. The word may, for example, include 24 bits, which would provide 16 million combinations.

The code generator also stores an auxiliary code of settable bit or bits. The illustrated example is of a single bit auxiliary code in which the bit is settable by push button 228. Additional bits and corresponding push buttons may be provided.

Transceivers 210 are provided with decoding means programmed to detect set bits in the auxiliary code, and to interpret the message accordingly. For example, a set bit may be used to indicate that the transmission is intended as a test of the system. It so, receipt of an emergency transmitter signal with that bit set will not produce a local alarm; and, when re-transmitted to the central station, will be identified as a test transmission so that receipt can be acknowledged.

In operation, a user initiates an emergency signal transmission by pressing push button(s) 226. If at that time, reset timer 224 has timed out since the last activation, its output is high, and the signal passed an AND gate 230. Code generator 220 produces an emergency signal for transmission including the personal identification code with the bits of the auxiliary code ZERO. This is a normal emergency signal, which will result in a local alarm and a request for security response.

The portable transmitter is programmed so that pressing button 228 alone has no effect. As illustrated in FIG. 2, programming is by logic AND gate which requires that button(s) 26 be pressed at the same time that button 228 is pressed for button 228 to have any effect. Of course the program may be set in software in a microprocessor, and logic gates are shown solely for illustration.

If the user had initiated a transmission by first depressing push button 228 and then, while holding button 228 down, depressing push button(s) 226, code generator 220 would have produced a signal for transmission including the personal identification code with the appropriate bit of the auxiliary code set to ONE. Transceiver 210, upon receipt of such a transmission, would interpret the set bit as a test signal according to a predetermined program or table lookup, and react in an appropriate mode.

A critical feature of the present invention is that the test mode be actuated by operation of at least the same element of the transmitter as are required to actuate the alarm mode. For example, the system can be modified so that test button 228 need not be held down to keep the transmitter the test mode. When pushed, test button 228 latches the transmitter in the test mode for a predetermined time period during which activation of button(s) 226 will signify that a test is being conducted.

In alternative embodiments, the concept of the present invention may be invoked on a transmitter that has two buttons which must be depressed simultaneously to invoke an alarm mode, but no test button per se. To test the transmitter, one would push one of the two alarm buttons, release it, and then (within a time-out period) push the other alarm button. A separate test button would not be required. Logic for such a system will readily occur to those skilled in the art.

In a variation of the last-mentioned embodiment, the test mode would be entered by a user holding one of the two alarm buttons until expiration of a time-out period of, say, five minutes. Upon time-out the user is notified such as by a "beep" or lamp, whereupon the user may depress the second alarm button to activate the test mode. If the second button is pushed before the expiration of the time-out period, an alarm signal will be sent.

OPERATION OF PREFERRED AND ALTERNATIVE EMBODIMENTS

Figure 7:
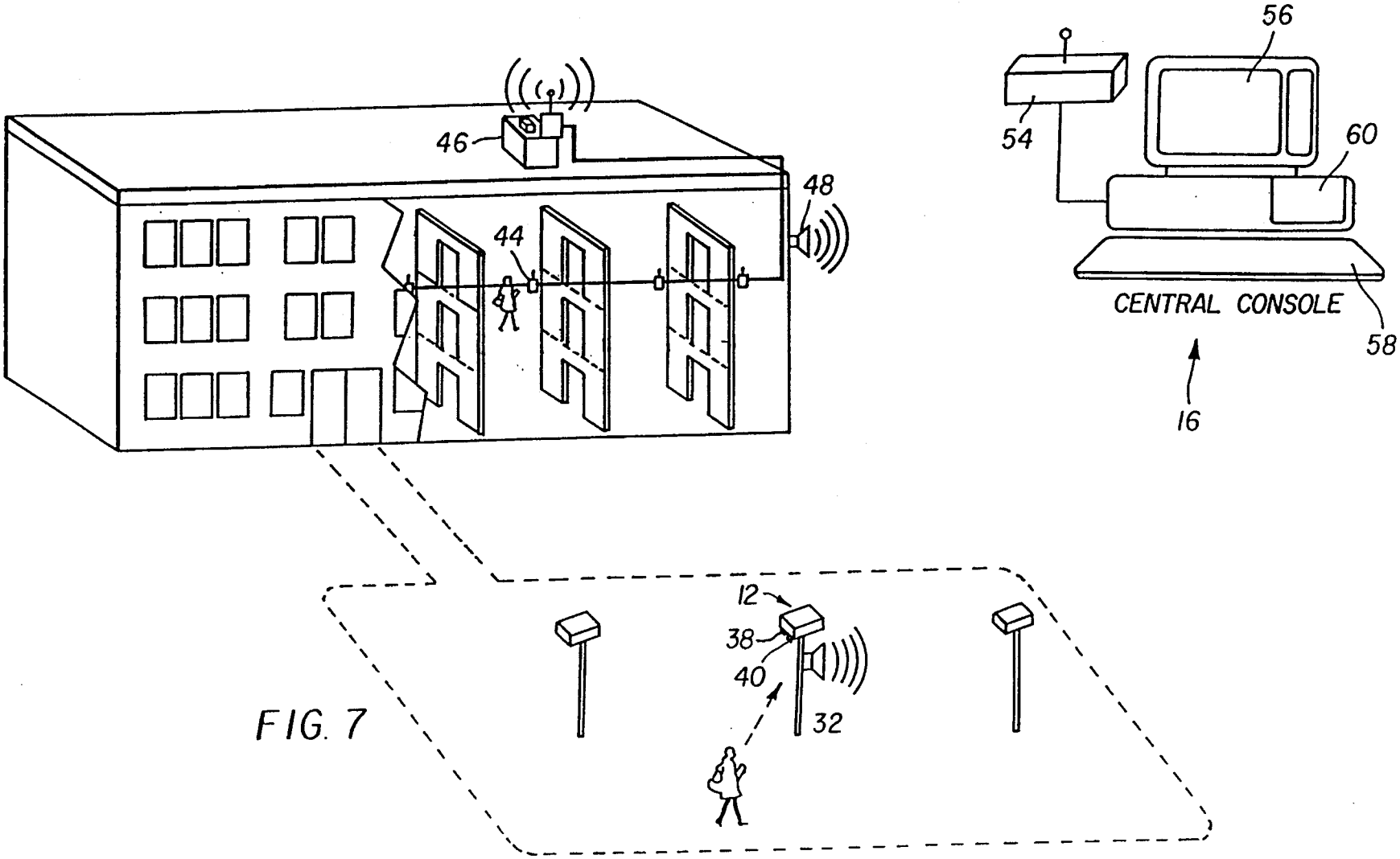
FIG. 7 is a schematic representation of a security system according to either disclosed embodiment, using the reference characters of the preferred embodiment, and depicting operation of the system by subscribers.

The system is depicted in FIG. 7 as it might operate with any of the above described embodiments. The reference numerals are those associated with the preferred embodiment. One or more subscribers about to enter an area of uncertain security might test the system by actuating their portable transmitters in the test mode. Such a test can be conducted at any time from any location, and the results of the test will be visible quickly wherever the LEDs are located, typically on receivers. If the test is successful, and the green LED is energized, the subscriber could proceed with confidence that the system is operational. The same mechanical and electrical switches required in the transmitter for an alarm operated for the test under the then existing battery and other operating conditions. The transmitter successfully communicated with the receiver, which successfully communicated with the central station, using the same components required for an alarm, and the identification codes of the transmitter and receiver were recognized.

Such a test by one subscriber does not disable the alarm capability of the system for others. The system operates on each transmission and treats it as an alarm or test depending on the setting of the alarm and test bits in the transmission.

Since the central station can identify the unique codes of the portable transmitters and receivers involved in each test, it can use subscriber tests to identify who has used the system and from what locations. Locations that have been involved in subscriber tests might be tested less frequently by the system operator. Subscribers who have not conducted tests might be contacted to make sure they know how to operate the system.

The invention has been described in detail with particular reference to preferred and alternative embodiments thereof, but it will be understood that variations and modifications can be effected within the spirit and scope of the invention.

What is claimed is:

1. A security system for use by multiple subscribers and comprising:

a portable transmitter having first and second modes of operation for transmitting in said first mode an emergency signal and for transmitting in said second mode a modified emergency signal to indicate a test;

a central station including subscriber information;

a transceiver for receiving emergency and modified signals from said portable transmitter and for communicating with said central station, said transceiver having a) a first mode of operation responding to successful receipt of emergency signals from said portable transmitter and successful communication regarding said emergency signals with said central station, and b) a second mode of operation responding to successful receipt of modified signals from said portable transmitter and successful communication regarding said modified signals with said central station, said transceiver in said first mode issuing an alarm signal and in said second mode issuing a test signal discernible as a test from the vicinity of the transceiver.

2. A security system according to claim 1, wherein said transmission in said first and second transmitter modes includes an identification code unique to said portable transmitter, said central station includes information matching said unique identification code to a subscriber, and successful communication between said transceiver and said central station in said second mode of said transceiver includes matching said unique identification code with a subscriber in the central station.

3. A security system according to claim 2, wherein said portable transmitter uses at least the same electrical components in said second mode as said first mode.

4. A security system according to claim 3, wherein said portable transmitter uses at least the same mechanical components in said second mode as said first mode.

5. A security system according to claim 2, wherein said transceiver is employed with a plurality of portable transmitters, and said transceiver responds in said first and second transceiver modes, respectively, on a transmission-by-transmission basis.

* * * * *